US007602286B2

(12) United States Patent
DiPoala

(10) Patent No.: US 7,602,286 B2
(45) Date of Patent: Oct. 13, 2009

(54) TAMPER DETECTOR FOR A SECURITY SENSOR

(75) Inventor: William DiPoala, Fairport, NY (US)

(73) Assignee: Robert Bosch GmbH, Stuttgart (DE)

( * ) Notice: Subject to any disclaimer, the term of this patent is extended or adjusted under 35 U.S.C. 154(b) by 286 days.

(21) Appl. No.: 11/774,826

(22) Filed: Jul. 9, 2007

(65) Prior Publication Data

US 2009/0015405 A1 Jan. 15, 2009

(51) Int. Cl.
*G08B 13/08* (2006.01)

(52) U.S. Cl. ..... 340/545.3; 340/545.1; 340/541; 250/221

(58) Field of Classification Search ..... 340/545.1, 340/545.3, 541; 250/221
See application file for complete search history.

(56) References Cited

U.S. PATENT DOCUMENTS

| | | | | |
|---|---|---|---|---|
| 4,507,654 | A | 3/1985 | Stolarczyk et al. | |
| 4,772,878 | A | 9/1988 | Kane | |
| 5,214,293 | A | 5/1993 | MacNiel | |
| 5,753,983 | A * | 5/1998 | Dickie et al. | 307/141.4 |
| 5,910,768 | A | 6/1999 | Ott | |
| 5,912,619 | A * | 6/1999 | Vogt | 340/545.1 |
| 5,914,664 | A * | 6/1999 | Scheele | 340/644 |
| 6,642,846 | B1 * | 11/2003 | Krubiner et al. | 340/545.3 |
| 6,714,131 | B2 * | 3/2004 | Iwasawa et al. | 340/556 |
| 6,956,479 | B2 | 10/2005 | Kelsch et al. | |
| 7,170,403 | B2 * | 1/2007 | Noguchi | 340/507 |
| 7,388,484 | B2 * | 6/2008 | Hsu | 340/539.31 |
| 2007/0210911 | A1 * | 9/2007 | McCulloch et al. | 340/507 |

* cited by examiner

*Primary Examiner*—Eric M Blount
(74) *Attorney, Agent, or Firm*—Sarah L. Taylor

(57) ABSTRACT

A security arrangement includes a mounting device having an upstanding wall. The mounting device is mounted to a surface of a structure such that the wall is oriented substantially perpendicular to the surface. A security sensor senses an event that occurs outside of the security arrangement. A tamper detector is attached to the security sensor and includes an optical emitter, an optical receiver, and a slot disposed between the emitter and the receiver. The emitter transmits optical energy that is received by the receiver through the slot. The wall of the mounting device is received in the slot when the tamper detector is coupled to the mounting device to thereby block the transmission of the optical energy from the emitter to the receiver. A controller is communicatively coupled to the receiver and produces a tamper signal in response to the receiver receiving the optical energy.

35 Claims, 11 Drawing Sheets

TAMPER DETECTOR FOR A SECURITY SENSOR

BACKGROUND OF THE INVENTION

1. Field of the Invention

The present invention relates to surveillance system sensors, and, more particularly, to an arrangement for detecting tampering with a surveillance system sensor.

2. Description of the Related Art

Surveillance systems, also known as security systems, are known to include various types of sensors for monitoring a building structure or an area of space for certain phenomena or events, such as a breach of security. For example, the security sensors may include door sensors for detecting the opening and closing of a door, window sensors for detecting the opening and closing of a window, or passive infrared (PIR) sensors for detecting motion or the presence of a living being.

Door/window sensors are known to be in the form of a pushbutton that is mounted to the door/window frame and is held in a depressed state by the door or window when the door or window is in a closed position. When opening, the door or window moves away from the pushbutton, thereby releasing the pushbutton from the depressed state. A controller monitors the state of the pushbutton, and may issue an alarm signal if the door or window is opened without authorization. Door/window sensors may also be optically based, wherein the reception of an optical signal is either disrupted or initiated upon the opening of the window or door. As another alternative, door/window sensors may be magnetically based. More specifically, a magnet may be placed near the outer perimeter of the door or window, and a reed switch may be mounted in the frame of the door or window such that the reed switch is adjacent to the magnet when the door/window is closed. In operation, the reed switch may continuously or periodically monitor the presence of the magnetic field. If the door/window is opened, the reed switch detects the absence of the magnetic field and informs a controller.

For detecting motion, PIR sensors may be mounted to a wall about eight feet off the floor. The PIR sensor may sense the presence of a warm body within its field of view by detecting the infrared radiation produced by the body.

A problem with many of these types of security sensors is that it is possible for an intruder to defeat the sensor it by various techniques that include removing the sensor from the surface to which it is mounted. As one example, a PIR sensor may be removed from its mounting and the PIR sensor may then be redirected in a direction such that any intruders will not be within the sensor's field of view. As another example, it is possible to defeat an optical door/window sensor by removing the optical sensor from its mounting while replicating the optical signal such that reception of the signal is not interrupted while the door or window is opened.

What is needed in the art is a security sensor that cannot be easily defeated by techniques that involve removing the sensor from the surface to which it is mounted.

SUMMARY OF THE INVENTION

The present invention provides a security arrangement in which a tamper detector senses when the security sensor is removed from the surface to which it is mounted. The tamper detector includes an emitter that produces optical energy that may be received by a receiver. In one embodiment, the optical energy may be diverted away from the receiver when the security sensor is properly mounted to the surface. However, if the security sensor is removed from the surface, then the optical energy is no longer diverted from the receiver. Reception of the optical energy by the receiver may indicate to the system that the security sensor has been tampered with.

In another embodiment, the optical energy from the emitter may be allowed to be received by the receiver when the security sensor is properly mounted to the surface. However, if the security sensor is removed from the surface, then the reception of the optical energy by the receiver is at least temporarily interrupted. The interruption of the reception of the optical energy by the receiver may indicate to the system that the security sensor has been tampered with.

In one embodiment, the invention comprises a security arrangement including a mounting device having a diverting element. The mounting device is mounted to a building structure. A security device includes an optical emitter and an optical receiver. The diverting element is received in the security device when the security device is coupled to the mounting device. The emitter transmits optical energy that is received by the receiver when the security device is decoupled from the mounting device. The optical energy is diverted by the diverting element such that the optical energy is not received by the optical receiver when the security device is coupled to the mounting device.

The invention comprises, in another form thereof, a security arrangement including a mounting device having an upstanding wall. The mounting device is mounted to a surface of a structure such that the wall is oriented substantially perpendicular to the surface. A security sensor senses an event that occurs outside of the security arrangement. A tamper detector is attached to the security sensor and includes an optical emitter, an optical receiver, and a slot disposed between the emitter and the receiver. The emitter transmits optical energy that is received by the receiver through the slot. The wall of the mounting device is received in the slot when the tamper detector is coupled to the mounting device to thereby block the transmission of the optical energy from the emitter to the receiver. A controller is communicatively coupled to the receiver and produces a tamper signal in response to the receiver receiving the optical energy.

The invention comprises, in yet another form thereof, a security method including mounting a mounting device to a surface of a structure such that at least a portion of the mounting device is cantilevered from the surface. A security sensor is provided for sensing a security breach. A tamper detector is provided including an optical emitter, an optical receiver, and an air gap disposed between the emitter and the receiver. The emitter and receiver are configured such that the receiver is capable of receiving optical energy that is transmitted by the emitter through the air gap. The tamper detector is attached to the security sensor. The tamper detector is coupled to the mounting device such that the cantilevered portion of the mounting device is received in the air gap to thereby block the transmission of the optical energy from the emitter to the receiver. A tamper signal is produced in the event that the tamper detector is decoupled from the mounting device to thereby enable the receiver to receive the optical energy from the emitter.

The invention comprises, in still another form thereof, a security arrangement including a security device including an optical emitter and an optical receiver. A mounting device is mounted to a building structure. The mounting device may allow the receiver to receive optical energy from the emitter when the security device is coupled to the mounting device, and at least temporarily prevent the receiver from receiving optical energy from the emitter when the security device is decoupled from the mounting device. Alternatively, the mounting device may prevent the receiver from receiving optical energy from the emitter when the security device is coupled to the mounting device, and at least temporarily allow the receiver to receive optical energy from the emitter when the security device is decoupled from the mounting device.

The invention comprises, in a still further form thereof, a security method including mounting a mounting device to a surface of a structure. A security sensor configured to sense a security breach is provided. A tamper detector is provided including an optical emitter, an optical receiver, and an air gap disposed between the emitter and the receiver. The emitter and receiver are configured such that the receiver is capable of receiving optical energy that is transmitted by the emitter through the air gap. The tamper detector is attached to the security sensor. The tamper detector is coupled to the mounting device such that at least a portion of the mounting device is received in the air gap to thereby either block the transmission of the optical energy from the emitter to the receiver, or allow the transmission of the optical energy from the emitter to the receiver. A tamper signal is produced in the event that the tamper detector is decoupled from the mounting device to thereby either allow the receiver to receive the optical energy from the emitter, or prevent the receiver from receiving the optical energy from the emitter.

An advantage of the present invention is that it is difficult for a would-be intruder to defeat the security sensor. Because removal of the security sensor from its mounting would be detected, the would-be intruder may be forced to attempt to defeat the sensor while the sensor is properly mounted.

Another advantage is that the tamper detector itself is difficult to defeat. Because the optical emitter and receiver of the tamper detector are embedded in the mounting surface, it would be difficult to prevent a change the state of reception of the optical energy by the receiver while, at the same time, removing the security sensor from the mounting surface. More particularly, in embodiments in which the receiver is prevented from receiving optical energy from the emitter when the security sensor is properly mounted, it would be difficult to block the optical energy from reaching the receiver while, at the same time, removing the security sensor from the mounting surface. Conversely, in embodiments in which the receiver receives optical energy from the emitter when the security sensor is properly mounted, it would be difficult to prevent an interruption of the reception of the optical energy by the receiver while, at the same time, removing the security sensor from the mounting surface.

Yet another advantage is that tampering is detected by use of an optical sensor, and optical sensors are known to be highly reliable and durable.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
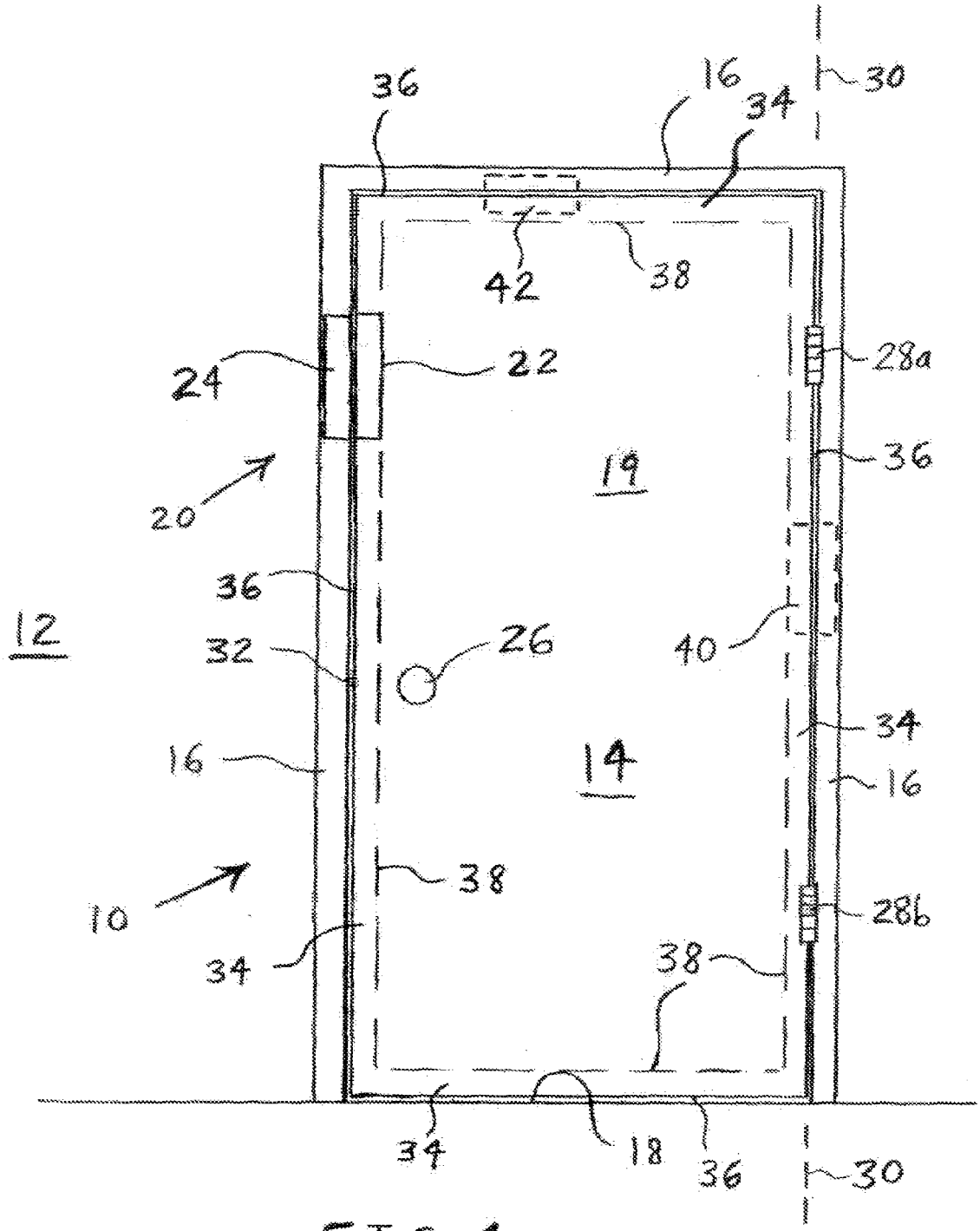
FIG. 1 is a plan view of one embodiment of a door assembly including a security arrangement of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security assembly, in particular a door assembly 10, of the present invention for incorporation into a structure 12 such as a building, or, more particularly, a wall of a building. Door assembly 10 includes a movable building structure in the form of a door 14, which is surrounded by portions of structure 12, such as a door frame 16 and a floor surface 18. Door frame 16 and a floor surface 18 define a building opening 19 in the form of a doorway that door 14 covers when door 14 is in a closed position and that door 14 uncovers when door 14 is in an open position. A security arrangement 20 is mounted partially within door 14 and partially within door frame 16. Security arrangement 20 includes a door-mounted portion 22 and a frame-mounted portion 24. Door-mounted portion 22 and frame-mounted portion 24 may be mounted in opposing locations within door 14 and door frame 16, respectively.

In one embodiment, frame-mounted portion 24 may be in the form of a pushbutton that is held in a depressed state by door-mounted portion 22 when door 14 is closed. In another embodiment, frame-mounted portion 24 may be in the form of an optical emitter that emits optical energy that is reflected by door-mounted portion 22 back to an optical receiver that is also in frame-mounted portion 24 when door 14 is closed. In yet another embodiment, frame-mounted portion 24 may be in the form of a reed switch that senses the presence of a magnet in door-mounted portion 22 when door 14 is closed.

Door 14 may be opened by manually grasping knob 26 and rotating door 14 about hinges 28*a*, 28*b*, i.e., about an axis 30 defined by hinges 28, as is well known. If door 14 is locked, i.e., if a latch 32 of door 14 is locked in a coupled state with frame 16, an intruder may nevertheless open door 14 by breaking hinges 28 and/or latch 32 away from frame 16, thereby allowing door 14 to be moved away from frame 16, as is also well known.

Door-mounted portion 22 may be mounted in or on a surface of door 14 at a location that is along a perimeter 34 of door 14. Perimeter 34 may be defined as an outer section of door 14 that is between outer edges 36 of door 14 and locations indicated generally by dashed line 38. Door-mounted portion 22 is shown mounted in a surface of perimeter 34 that is disposed opposite from hinges 28. However, door-mounted portion 22 could alternatively be mounted in a surface of perimeter 34 that is adjacent to hinges 28, as indicated at 40. Moreover, door-mounted portion 22 could be mounted not in a jamb, but rather in a surface of an upper portion of perimeter 34, as indicated at 42.

Regardless of in which location in the surface of perimeter 34 door-mounted portion 22 is mounted, frame-mounted portion 24 may be mounted in a surface of door frame 16 at a location that opposes the mounting location of door-mounted portion 22.

Figure 2:
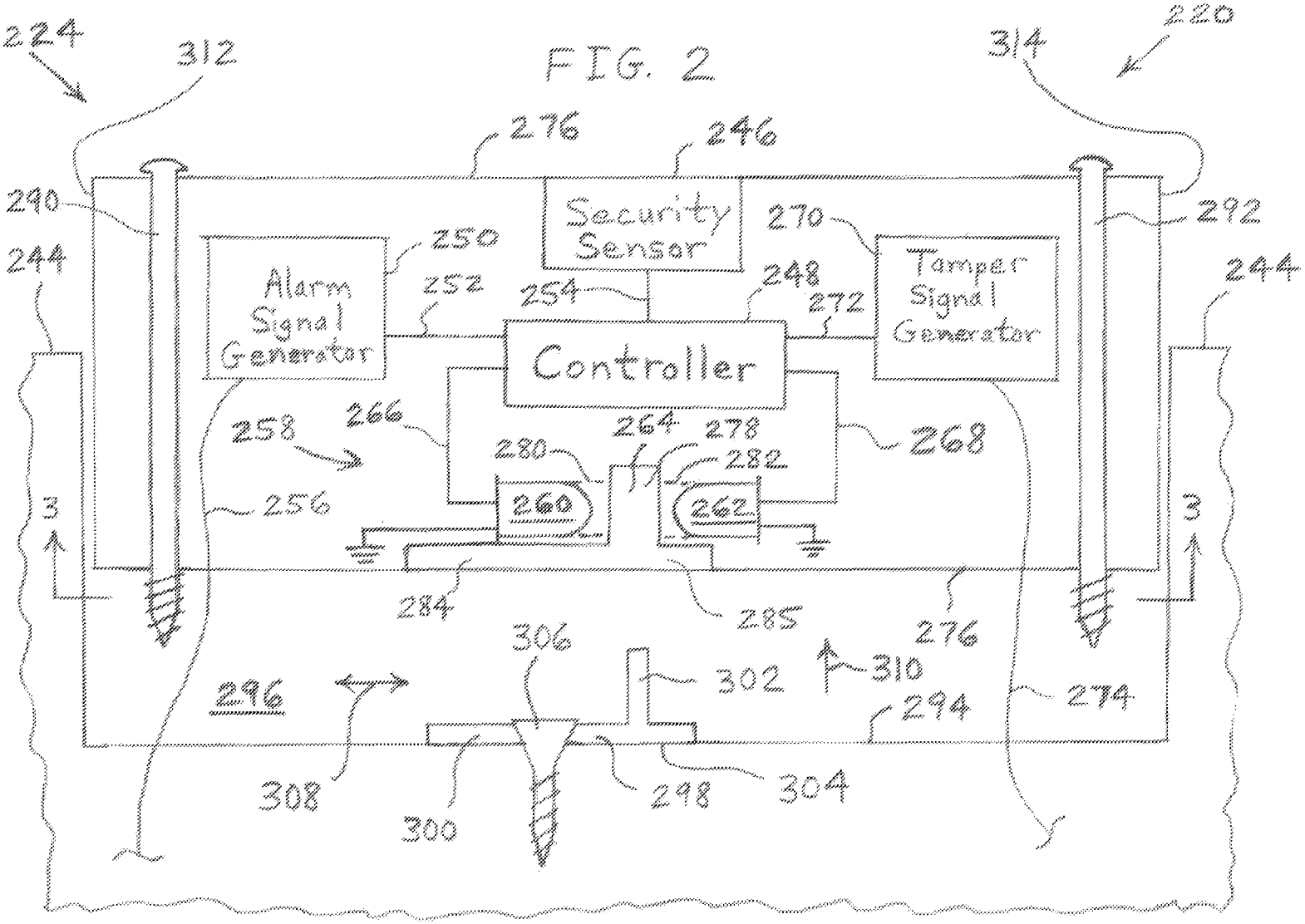
FIG. 2 is a block diagram of one embodiment of the security arrangement of FIG. 1.

FIG. 2 illustrates a more general form of a security arrangement 220 of the present invention including a portion 224 in the form of a security device that may be mounted in or to a surface 244. Surface 244 may be the surface of a door frame, window frame, wall, or any other fixed or movable structure. Security arrangement 220 may also include another opposing portion (not shown) that may be mounted in a door or window in the case of a door/window sensor. However, the presence of such an opposing portion is not a requirement of the invention. For example, security arrangement 220 may include a security sensor 246 that is in the form of a PIR motion detector that monitors infrared energy within its field of view, and that is not associated with any opposing portion. Alternatively, security sensor 246 may be in the form of a pushbutton, optical sensor, or magnetic reed switch sensor, for example.

As shown in FIG. 2, security sensor 246 may be electrically connected to a controller 248, such as through line 254. Controller 48 may receive signals from security sensor 246 that are indicative of whether a breach in security has occurred. For example, in the case of PIR motion detection, sensor 246 may transmit a signal to controller 248 that indicates that sensor 246 has detected the heat from, i.e., the presence of, an intruder. In the case of door/window sensing, sensor 246 may transmit a signal to controller 248 that indicates that the opening of an associated door or window has been detected. In the event that sensor 246 indicates to controller 248 that such a security breach or other phenomenon has occurred, then controller 248 may transmit a signal to alarm signal generator 250 on line 252 instructing alarm signal generator 250 to transmit an alarm signal on line 256. The alarm signal on line 256 may be transmitted to a central controller, police station, and/or siren, for example.

Security arrangement 220 also includes a tamper detector 258 including an optical emitter 260 and an optical receiver 262. Emitter 260 and receiver 262 are positioned relative to each other such that optical energy, such as infrared energy, emitted through an air gap 264 by emitter 260 may be received and detected by receiver 262. Controller 248 may be electrically connected to emitter 260 via line 266 such that controller 248 may supply electrical power to emitter 260 and thereby control the time periods in which emitter 260 emits optical energy. However, in one embodiment, emitter 260 emits optical energy substantially continuously. Controller 248 may be communicatively coupled to receiver 262. Specifically, controller 248 may be electrically connected to receiver 262 via line 268 such that receiver 262 continuously or periodically informs controller 248 whether or not receiver 262 is receiving optical energy of a selected range of wavelengths.

As described in more detail hereinbelow, receiver 262 receiving optical energy and consequently transmitting a signal on line 268 to controller 248 may be an indication that tampering with security arrangement 220 has occurred. Controller 248 may then transmit a signal to tamper signal generator 270 on line 272 instructing tamper signal generator 270 to transmit a tamper signal on line 274. The tamper signal on line 274 may be transmitted to a central controller, police station, and/or siren, for example.

As shown in FIG. 2, security sensor 246, controller 248, alarm signal generator 250, emitter 260, receiver 262 and tamper signal generator 270 may all be contained within and attached to a body 276, which may be formed of plastic, for example. Body 276 may include a slot 278 that defines air gap 264. Body 276 may also include mutually aligned conduits 280, 282 that are in communication with slot 278 and that provide a clear path for the transmission of optical energy from emitter 260 to receiver 262. Thus, emitter may emit optical energy into slot 278, and receiver 262 may receive the optical energy from slot 278.

Figure 3:
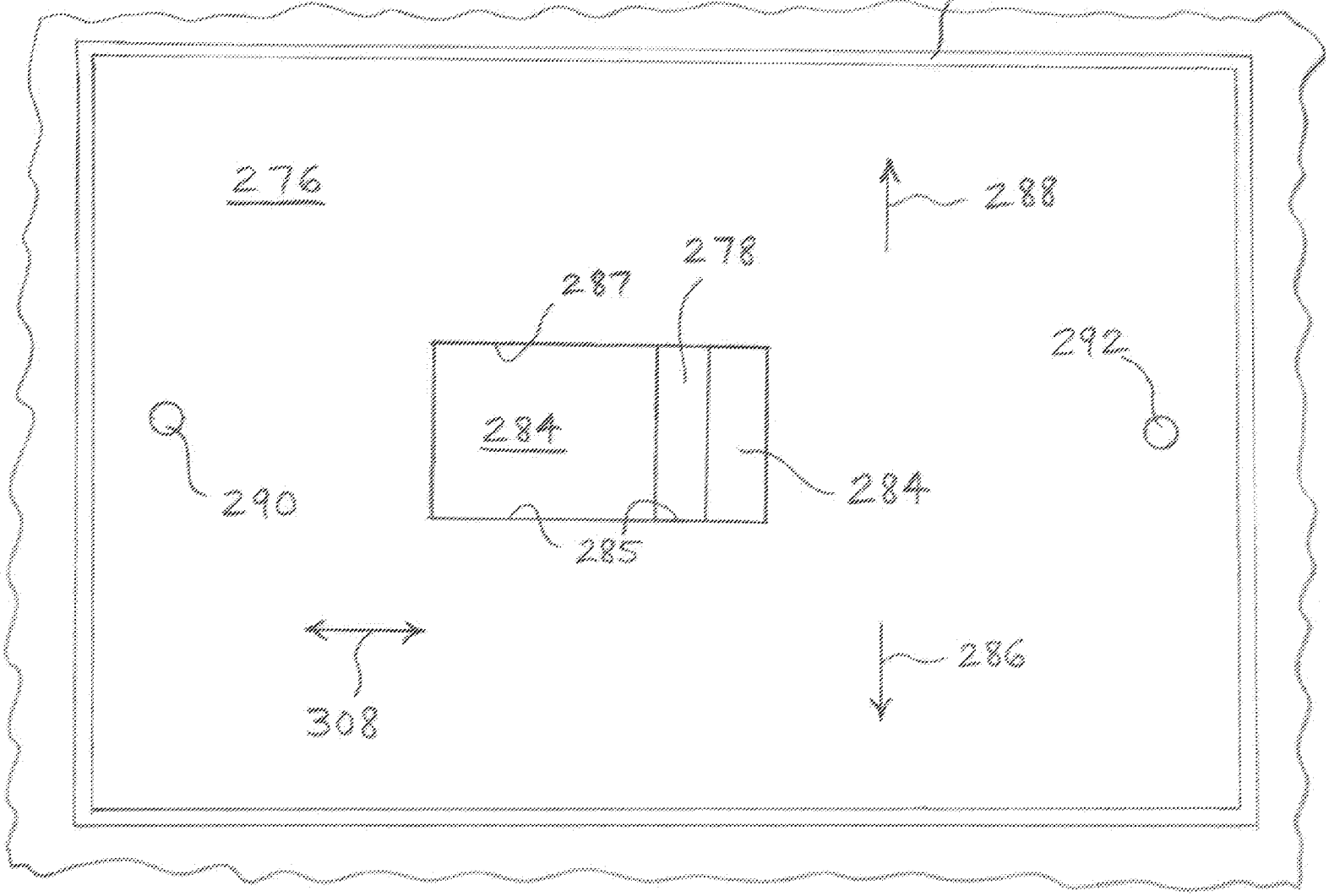
FIG. 3 is a plan view along line 3-3 in FIG. 2.

Body 276 also may include a rectangular cutout 284, best shown in FIG. 3, which is in communication with slot 278. Slot 278 and cutout 284 are bordered by walls 285, 287 in lateral directions 286, 288 (FIG. 3) that are respectively into and out of the page of FIG. 2. Fastening devices 290, 292 may extend through throughholes in body 276 to fasten portion 224 to a recessed surface 294 of a recess 296 in which body 276 is received. As shown in FIG. 3, body 276 and recess 296 may be sized such that body 276 is snugly received in recess 296.

Figure 4:
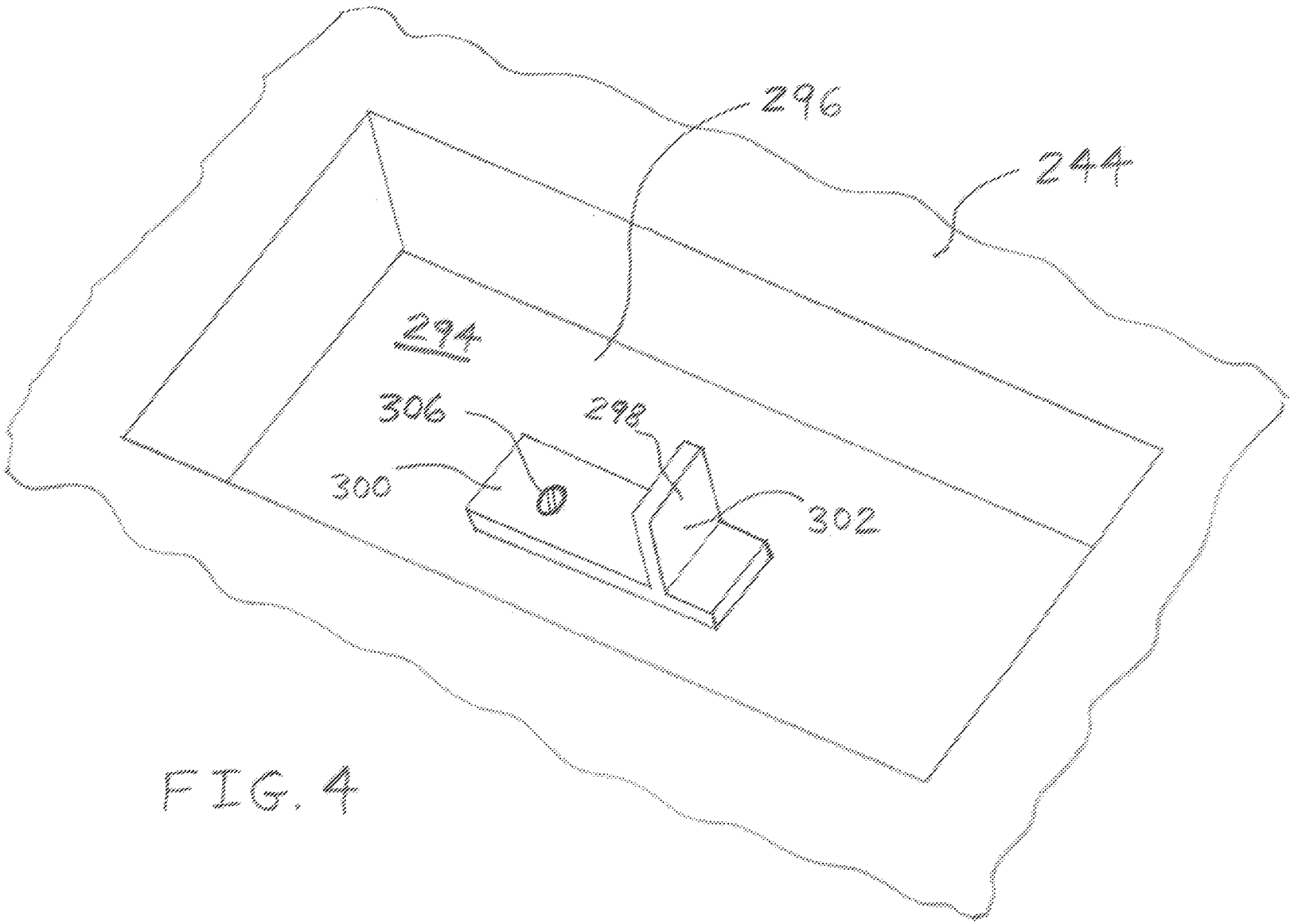
FIG. 4 is a perspective view of the mounting device of FIG. 2 mounted to the recessed surface.

Also mounted to recessed surface 294 is a mounting device 298 which is best shown in FIG. 4. In the illustrated embodiment, mounting device 298 includes a rectangular base plate 300 and a rectangular upstanding wall 302 extending or cantilevered perpendicularly from base plate 300. Base plate 300 includes a planar surface 304 engaging recessed surface 294. A fastening device, such as a screw 306, may extend through a throughhole in base plate 300 to thereby secure mounting device 298 to recessed surface 294 such that wall 302 is oriented perpendicular to surface 294.

Mounting device 298 may be sized to be snugly received in slot 278 and in cutout 284. More particularly, upstanding wall 302 may be sized to be snugly received in slot 278, and baseplate 300 may be sized to be snugly received in cutout 284. In one embodiment, slot 278 has a width in directions indicated by double arrow 308 that is no more than twice a width of upstanding wall 302 in directions indicated by double arrow 308.

Upstanding wall 302 may have a height in direction 310 that is sufficient to enable wall 302 to divert or block the optical energy from emitter 260 from reaching receiver 262 when body 276 is secured to surface 294 or when mounting device 298 is received in slot 278 and in cutout 284. Cutout 284 may have a height in direction 310 this is equal to or greater than the height of base plate 300 in direction 310. Thus, body 276 may cover base plate 300 of mounting device 298 when portion 224 is coupled to mounting device 298. More generally, a tamper detector, such as tamper detector 258, may cover upstanding wall 302 and possibly base plate 300 when the tamper detector is coupled to mounting device 298.

Figure 5:
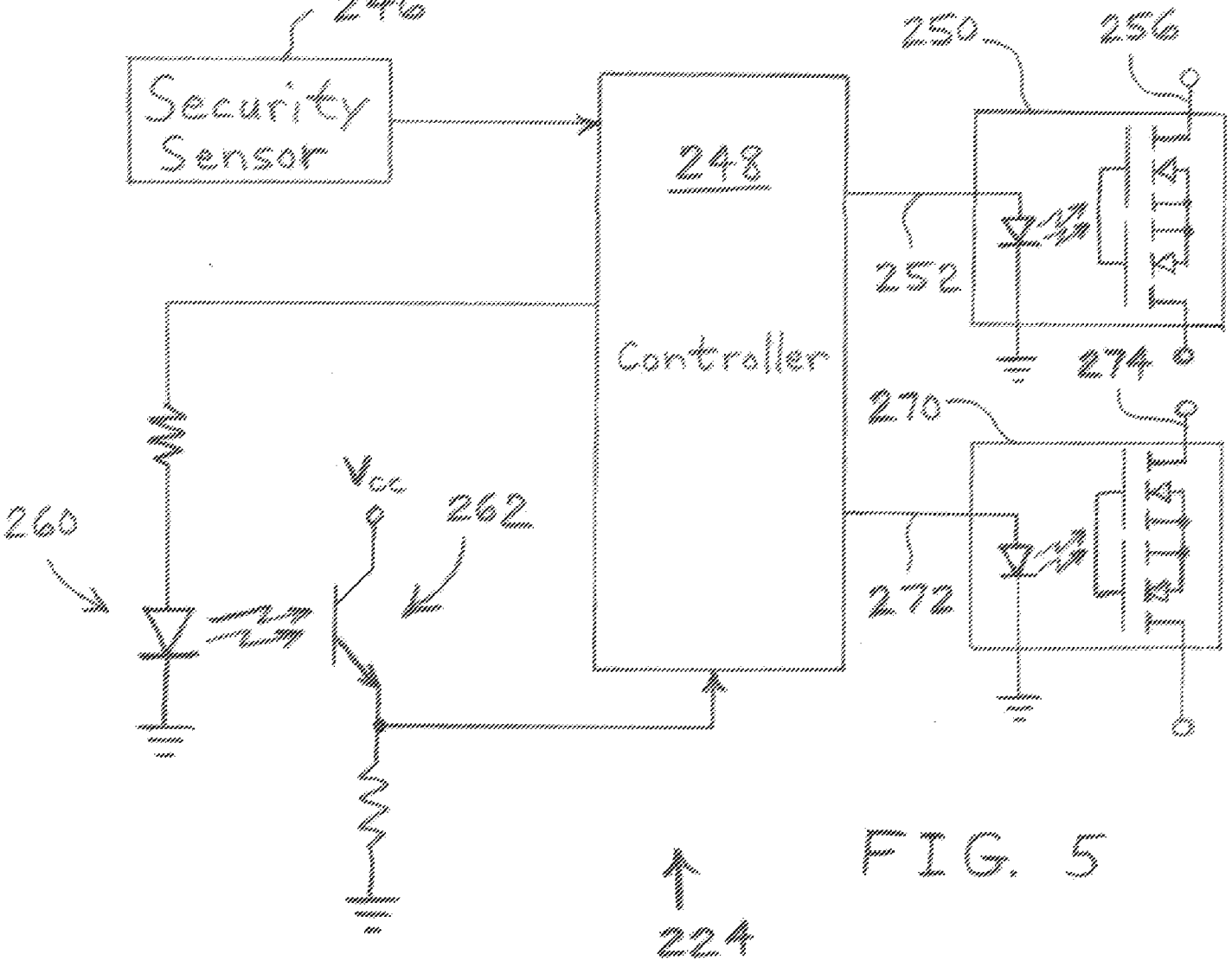
FIG. 5 is a schematic diagram of the security arrangement of FIG. 2.

A schematic diagram of one embodiment of security device 224 is shown in FIG. 5. Optical emitter 260 is shown in the form of an infrared light emitting diode, and optical receiver 262 is shown in the form of an infrared phototransistor. Alarm signal generator 250 and tamper signal generator 270 are shown in the form of respective solid state relays.

As shown in FIG. 2, security device 224 and mounting device 298 are received in a recess 296 in a surface 244 of a structure. However, it is also possible within the scope of the invention for security device 224 and mounting device 298 to be mounted on a substantially planar surface such that side surfaces 312, 314 of body 276 are exposed.

During installation, mounting device 298 may be screwed to a mounting surface, such as recessed surface 294. Body 276 may then be coupled to mounting device 298 by aligning slot 278 with upstanding wall 302, aligning cutout 284 with baseplate 300, and placing body 276 over mounting device 298 such that body 276 covers mounting device 298. Mounting device 298 may be snugly received in slot 278 and cutout 284. If the mounting device is secured to a recessed surface, then the body may be snugly received in the recess, as body 276 is snugly received in recess 296. After body 276 is in place, body 276 may be secured to recessed surface 294 by screwing screws 290, 292 into surface 294 to thereby inhibit decoupling of tamper detector 258 from mounting device 298.

During use and after installation, controller 248 may apply power to emitter 260 to thereby cause emitter 260 to emit optical energy. A diverting element, such as upstanding wall 302, disposed in air gap 264 may prevent the optical energy from being received by receiver 262. Regardless of whether the security device is mounted to a planar surface or to a recessed surface, if the security device is pulled away from the planar or recessed surface, and thus away from the mounting device, then the diverting element will be withdrawn from the air gap, thereby allowing the receiver to receive the optical energy from the emitter. Upon the receiver receiving the optical energy, a tamper signal may be generated, and appropriate actions may be taken in response to the tampering.

Figure 6:
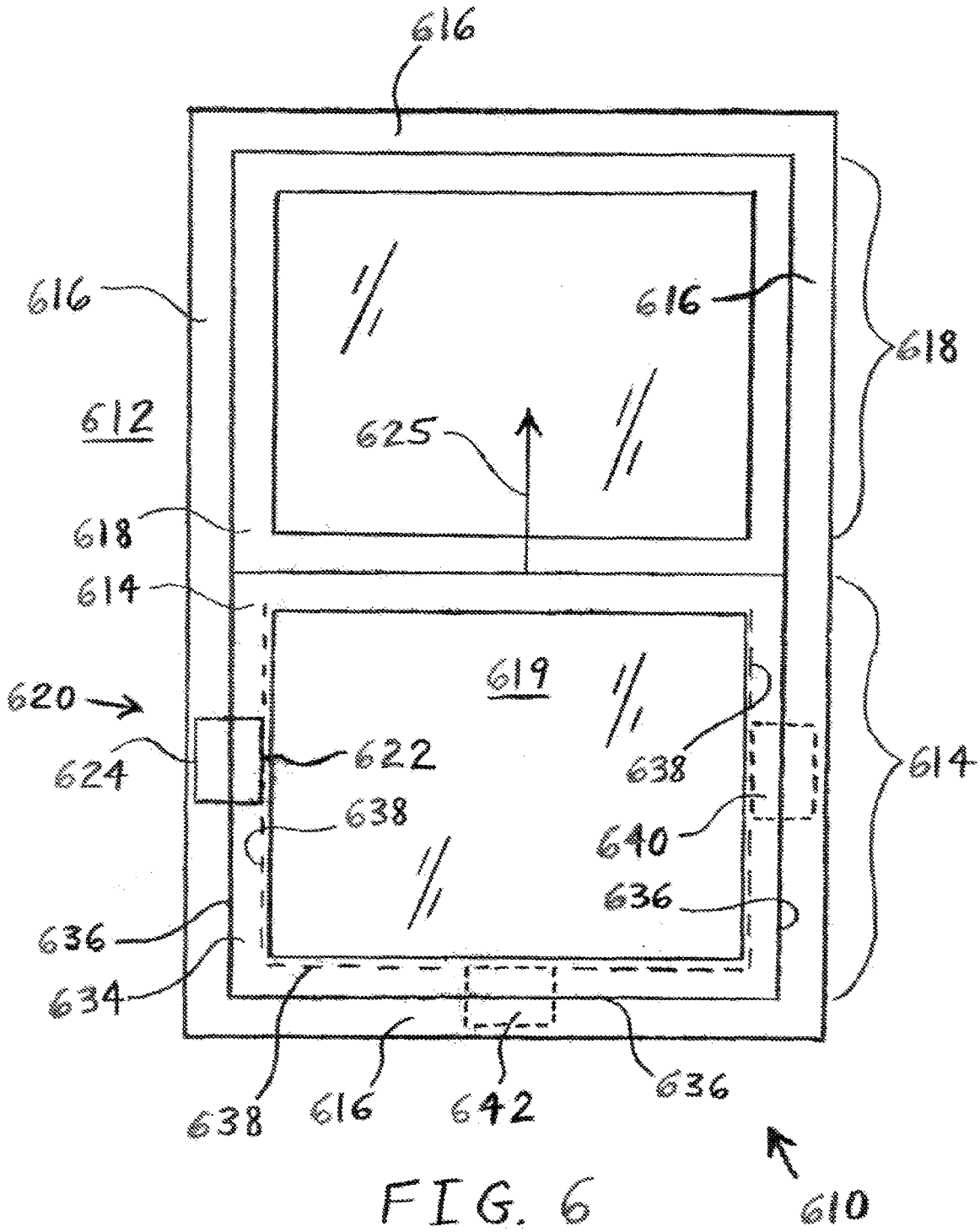
FIG. 6 is a plan view of one embodiment of a window assembly including a security arrangement of the present invention.

In FIG. 6, there is shown another embodiment of a security assembly of the present invention in the form of a window assembly 610 for incorporation into a structure 612 such as a building, or, more particularly, a wall of a building. Window assembly 610 includes a movable building structure in the form of a movable window sash 614, which is surrounded by portions of structure 612, such as a wall, a window frame 616 and a fixed window sash 618. Window frame 616 and a fixed window sash 618 define a building opening 619 in the form of a window opening that sash 614 covers when sash 614 is in a closed position and that sash 614 uncovers when sash 614 is in an open position. A security arrangement 620 is mounted partially within sash 614 and partially within window frame 616. More particularly, security arrangement 620 includes a window-mounted portion 622 and a frame-mounted portion 624. Window-mounted portion 622 and frame-mounted portion 624 may be mounted in opposing locations within door 614 and door frame 616, respectively.

Sash 614 may be opened by manually grasping sash 614 and sliding sash 614 in an upward direction 625, as is well known. Imaginary planes defined by sashes 614, 618 may be parallel to each other and displaced from each other in a direction into the page of FIG. 6. To at least partially open sash 614, and thereby at least partially uncover opening 619, sash 614 may be slid in direction 625 in tracks (not shown) in frame 616 such that sash 614 at least partially overlaps sash 618 in a direction into the page of FIG. 6, as is also well known.

Window-mounted portion 622 may be mounted in a surface of sash 614 at a location that is along a perimeter 634 of sash 614. Perimeter 634 may be defined as an outer section of sash 614 that is between outer edges 636 of sash 614 and locations indicated generally by dashed line 638. Window-mounted portion 622 is shown mounted in a vertically-oriented surface of perimeter 634. However, window-mounted portion 622 could alternatively be mounted in the portion of the surface of perimeter 634 that is on the other end of sash 614, as indicated at 640. Moreover, window-mounted portion 622 could be mounted not in a vertically-oriented surface, but rather in a horizontally-oriented surface of perimeter 634 that is disposed opposite the window sill, as indicated at 642. Regardless of in which location in the surface of perimeter 634 window-mounted portion 622 is mounted, frame-mounted portion 624 may be mounted in a surface of window frame 616 at a location that opposes the mounting location of window-mounted portion 622. Window-mounted portion 622 and frame-mounted portion 624 may be substantially similar to window-mounted portion 22 and frame-mounted portion 24, respectively, and thus will not be described in further detail herein.

Figure 7:
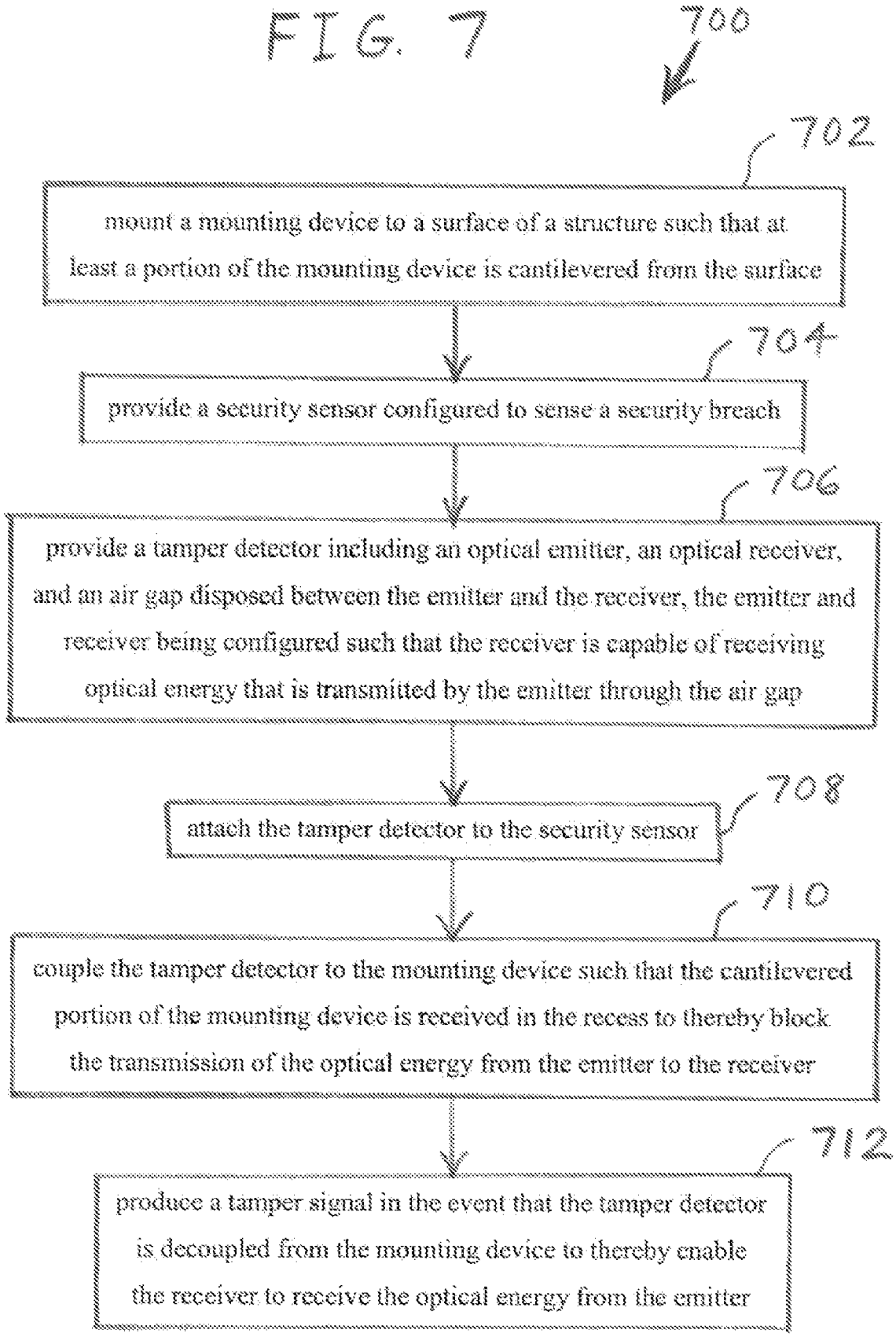
FIG. 7 is a flow chart of one embodiment of a security method of the present invention.

FIG. 7 illustrates one embodiment of a security method 700 of the present invention. In a first step 702, a mounting device is mounted to a surface of a structure such that at least a portion of the mounting device is cantilevered from the surface. For example, a mounting device 298 may be mounted to a surface 294 of a structure, such as a door frame 16, window frame 616 or wall, such that upstanding wall 302 is cantilevered from surface 294. In a next step 704, a security sensor configured to sense a security breach is provided. In particular, a security sensor such as a PIR motion detector or a door/window sensor may be provided. In step 706, a tamper detector including an optical emitter, an optical receiver, and an air gap disposed between the emitter and the receiver is provided, the emitter and receiver being configured such that the receiver is capable of receiving optical energy that is transmitted by the emitter through the air gap. For example, a tamper detector 258 including an optical emitter 260, an optical receiver 262, and an air gap 264 disposed between emitter 260 and receiver 262 is provided. Emitter 260 and receiver 262 are configured such that receiver 262 is capable of receiving optical energy that is transmitted by emitter 260 through air gap 264. In step 708, the tamper detector is attached to the security sensor. As an example, tamper detector 258 may be attached to security sensor 246 by virtue of both tamper detector 258 and security sensor 246 being contained within, and attached to, a same body 276. In a next step 710, the tamper detector is coupled to the mounting device such that the cantilevered portion of the mounting device is received in the air gap to thereby block the transmission of the optical energy from the emitter to the receiver. Particularly, tamper detector 258 may be coupled to mounting device 298 such that cantilevered portion 302 of mounting device 298 is received in air gap 264 to thereby block the transmission of the optical energy from emitter 260 to receiver 262. In a final step 712, a tamper signal is produced in the event that the tamper detector is decoupled from the mounting device to thereby enable the receiver to receive the optical energy from the emitter. That is, a tamper signal may be produced on line 274 if tamper detector 258 is decoupled from mounting device 298. The decoupling of tamper detector 258 from mounting device 298 may result in cantilevered portion 302 being withdrawn from air gap 264, which in turn may enable receiver 262 to receive optical energy from emitter 260.

The present invention has been primarily described herein in connection with sensing that a security sensor that is mounted on a fixed structure has been tampered with. However, it is to be understood that the features of the present invention described herein may be equally applicable to sensing that a security sensor that is mounted on a movable structure has been tampered with. Such a movable structure may include a sliding window or a sliding door, for example.

The present invention has been described herein in connection with sensing tampering with a security sensor that is mounted on a vertical surface of a structure. However, it is to be understood that the features of the present invention described herein may be equally applicable to sensing tampering with a security sensor that is mounted on a horizontal or other non-vertical surface. Such a non-vertical surface may include a floor or a ceiling, for example.

The present invention has been described herein as including a tamper detector wherein the reception of optical energy is initiated by removal of a security sensor from a mounting surface. However, the principles of the present invention may also be applicable to a tamper detector wherein the reception of optical energy occurs in the normal, non-tampered state, and the reception of optical energy is terminated by removal of a security sensor from a mounting surface. For example, a spring-loaded optical barrier may be biased into the air gap between the emitter and the receiver, and the cantilevered portion of the mounting device may be formed of an optically transparent material. When the security sensor is coupled to the mounting device, the cantilevered portion may push the optical barrier out of the air gap, against the force of the spring, to thereby allow the optical energy to pass through the transparent cantilevered portion and reach the receiver. Removal of the security sensor from the mounting surface may result in the spring being allowed to push the optical barrier back into the air gap, thereby terminating the reception of the optical energy.

Thus, within the scope of the invention, any change of state of the reception of optical energy of the receiver (i.e., the reception of optical energy by the receiver being at least temporarily interrupted or at least temporarily commenced) may be indicative of the security device being tampered with. Further, within the scope of the invention, the controller may generally be configured to produce a tamper signal in response to the security device being decoupled from the mounting device as indicated by at least a temporary change in state of the reception of the optical energy by the receiver.

Figure 8:
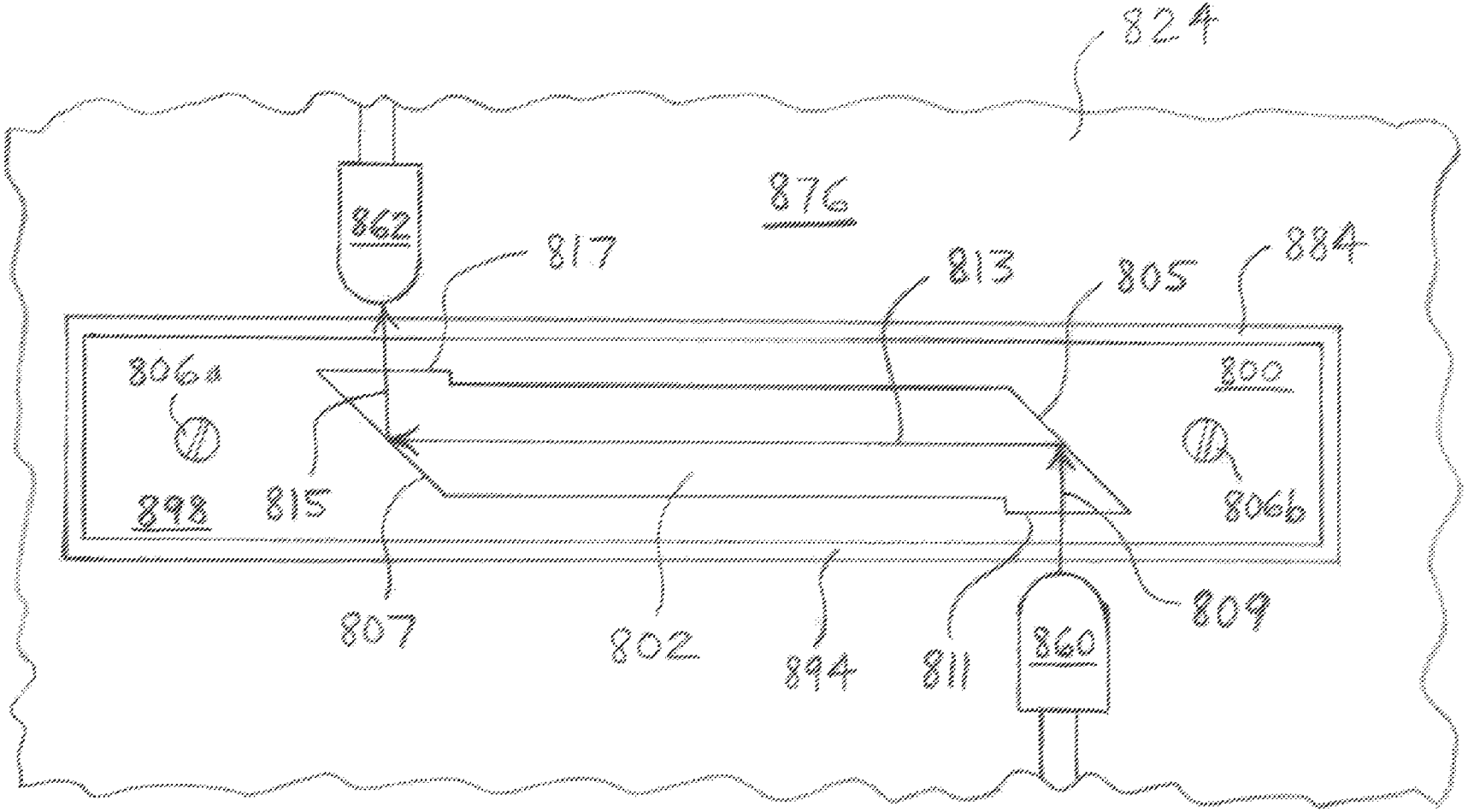
FIG. 8 is a plan view of another embodiment of an arrangement including a mounting device, an optical emitter, and an optical receiver suitable for use with the present invention.

Other embodiments in which the reception of optical energy occurs in the normal, non-tampered state, and the reception of optical energy is terminated or interrupted by removal of a security sensor from a mounting surface are illustrated in FIGS. 8-11. Particularly, FIG. 8 illustrates a security device 824 including an optical emitter 860 that is unaligned with an optical receiver 862. A body 876 of device 824 includes a slot 884 for receiving a mounting device 898 that includes a base plate 800 having an optical light pipe 802. Base plate 800 may be fastened or mounted to a surface 894 of a structure, such as a door frame, window frame or wall, by screws 806*a*, 806*b*. Light pipe 802 may include two parallel, reflective surfaces 805, 807 that are each oriented at an angle of about 45 degrees relative to a direction in which emitter 860 emits optical energy, as indicated at 809.

Base plate 800 may be formed of a material that is transparent to infrared optical energy. For example, base plate 800 may be formed of polycarbonate or acrylic material.

Mounting device 898 may be sized to be snugly received in slot 884 such that light pipe 802 is positioned to reflect optical energy from emitter 860 such that the optical energy may be received by optical receiver 862 when security device 824 is mounted to surface 894. More specifically, optical energy emitted by emitter 860 may be received in an opening 811 of light pipe 802, reflected by reflective surface 805 as indicated at 813, reflected again by reflective surface 807 as indicated at 815, and then received by receiver 862 through another opening 817 of light pipe 802.

If security device 824 is removed from surface 894, emitter 860 is no longer positioned to emit optical energy into light pipe 802, and thus receiver 862 no longer receives the optical energy due to the non-alignment of emitter 860 and receiver 862. If receiver 862 ceases to receive the optical energy from emitter 860, then it may be assumed that security device 824 has been removed from surface 894 or that security device 824 has been otherwise tampered with. Consequently, security device 824 may emit a tamper signal, similarly to the embodiment described above with respect to FIG. 2.

Figure 9:
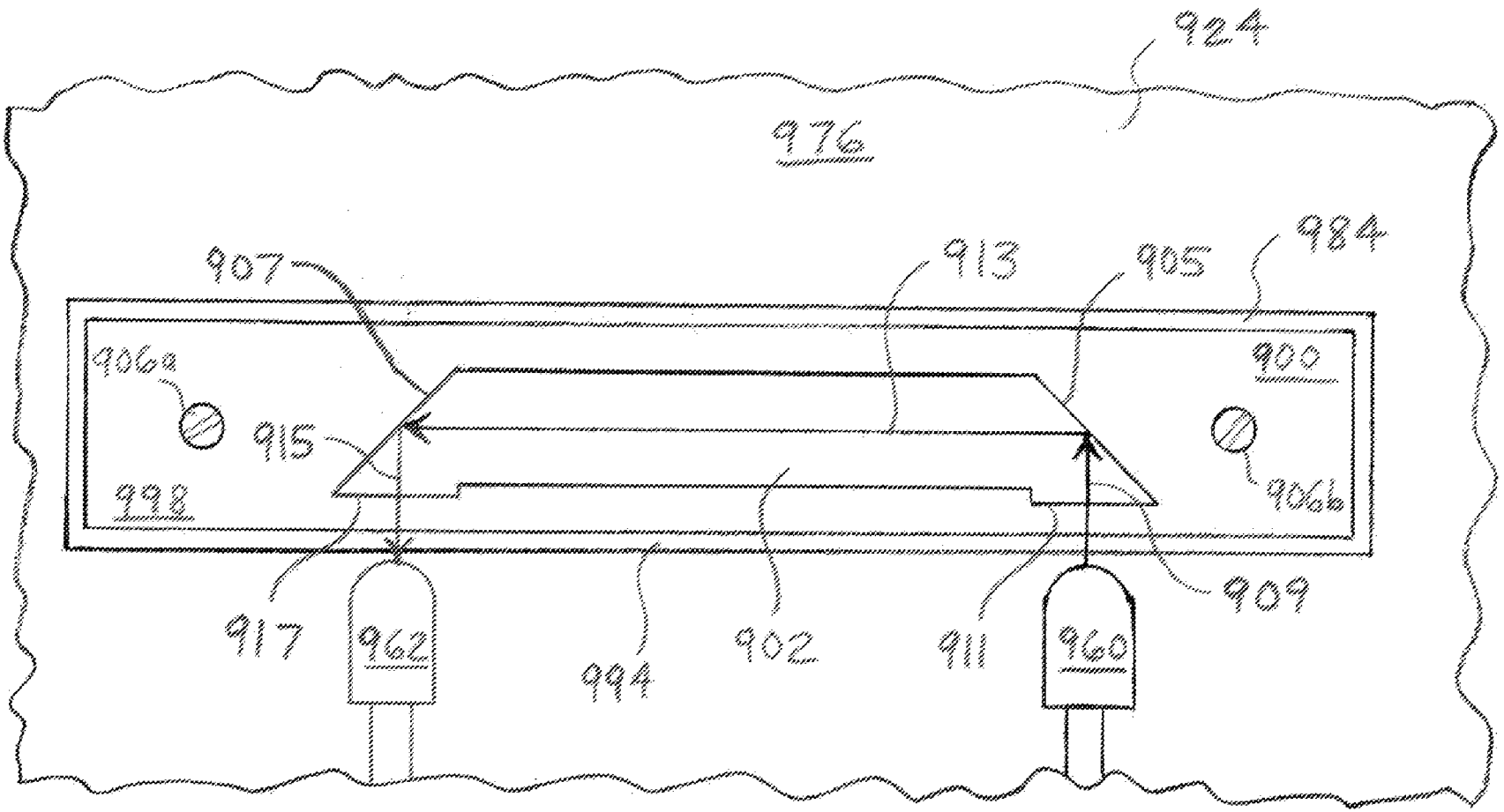
FIG. 9 is a plan view of yet another embodiment of an arrangement including a mounting device, an optical emitter, and an optical receiver suitable for use with the present invention.

FIG. 9 illustrates another arrangement that includes a light pipe and that is suitable for use in the present invention. A security device 924 includes an optical emitter 960 that is unaligned with an optical receiver 962. A body 976 of device 924 includes a slot 984 for receiving a mounting device 998 that includes a base plate 900 having an optical light pipe 902. Base plate 900 may be fastened or mounted to a surface 994 of a structure, such as a door frame, window frame or wall, by screws 906*a*, 906*b*. Light pipe 902 may include two reflective surfaces 905, 907 that are oriented at a right angle relative to each other, and that are each oriented at an angle of about 45 degrees relative to a direction in which emitter 960 emits optical energy, as indicated at 909.

Base plate 900 may be formed of a material that is transparent to infrared optical energy. For example, base plate 900 may be formed of polycarbonate or acrylic material.

Mounting device 998 may be sized to be snugly received in slot 984 such that light pipe 902 is positioned to reflect optical energy from emitter 960 such that the optical energy may be received by optical receiver 962 when security device 924 is mounted to surface 994. More specifically, optical energy emitted by emitter 960 may be received in an opening 911 of light pipe 902, reflected by reflective surface 905 as indicated at 913, reflected again by reflective surface 907 as indicated at 915, and then received by receiver 962 through another opening 917 of light pipe 902. Thus, light pipe 902 reflects the optical energy such that the energy is returned in a direction that is substantially opposite the direction in which the energy was received by light pipe 902.

If security device 924 is removed from surface 994, emitter 960 is no longer positioned to emit optical energy into light pipe 902, and thus receiver 962 no longer receives the optical energy due to the non-alignment of emitter 960 and receiver 962. If receiver 962 ceases to receive the optical energy from emitter 960, then it may be assumed that security device 924 has been removed from surface 994 or that security device 924 has been otherwise tampered with. Consequently, security device 924 may emit a tamper signal, similarly to the embodiment described above with respect to FIG. 2.

Figure 10:
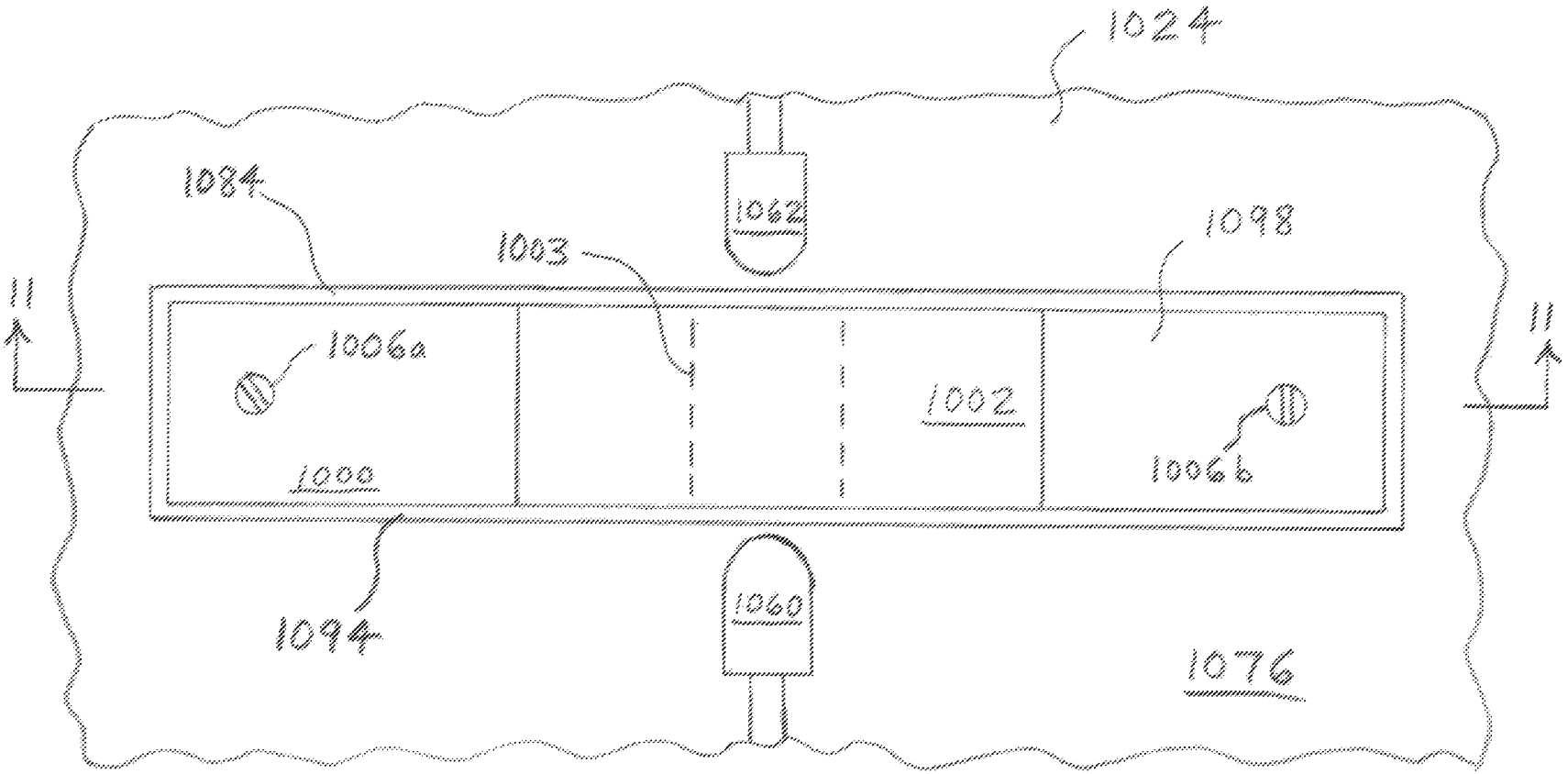
FIG. 10 is a plan view of still another embodiment of an arrangement including a mounting device, an optical emitter, and an optical receiver suitable for use with the present invention.
Figure 11:
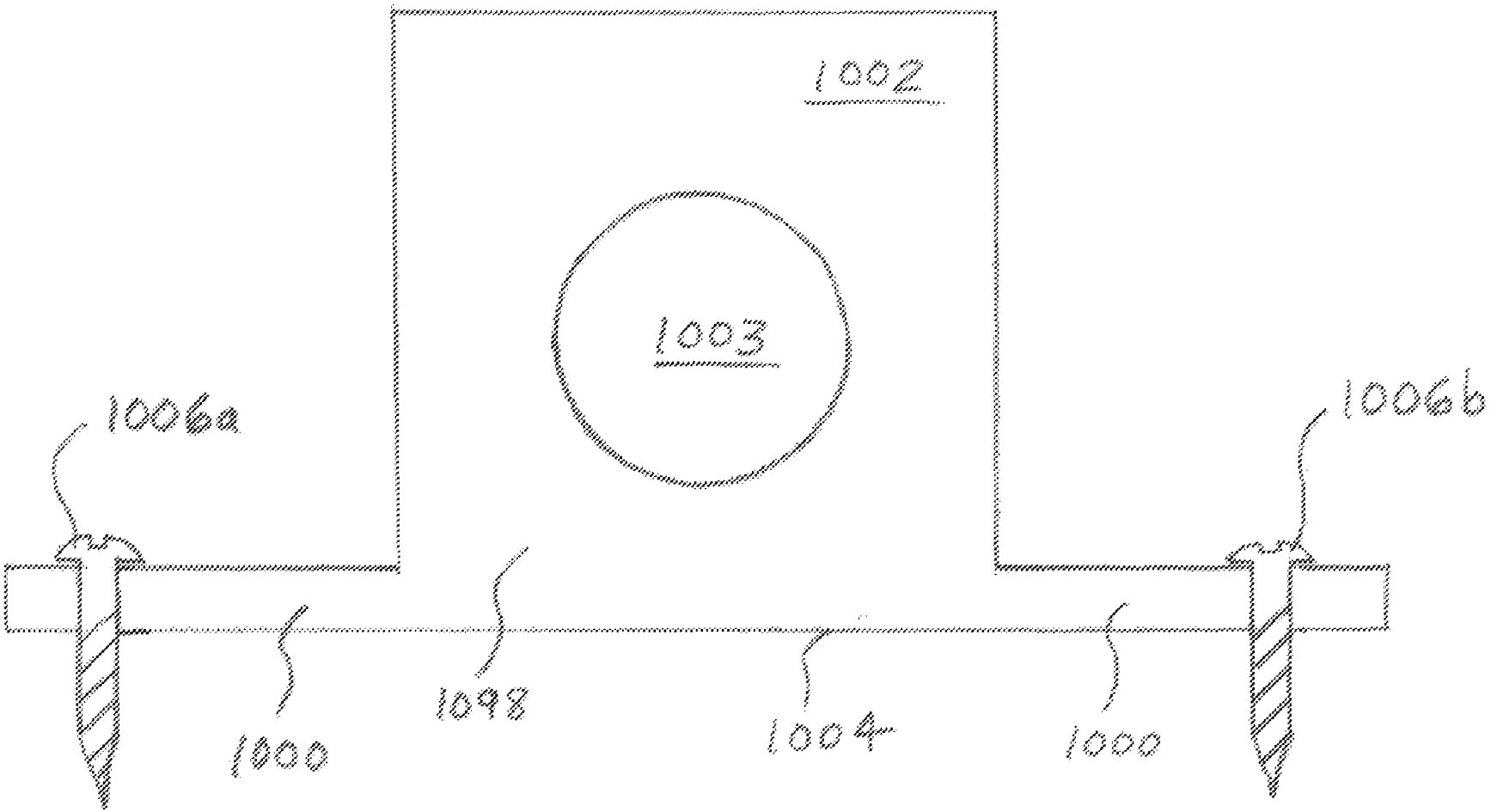
FIG. 11 is a side view of the mounting device of FIG. 10 along line 11-11.

FIGS. 10 and 11 illustrate an arrangement that is similar to that of FIG. 2 in that a mounting device 1098 includes a rectangular base plate 1000 and a rectangular upstanding wall 1002 extending or cantilevered perpendicularly from base plate 1000. Moreover, base plate 1000 includes a planar surface 1004 engaging surface 1094. However, wall 1002 includes a throughhole 1003 that allows optical energy to be received by receiver 1062 when a security device 1024 is in the untampered state. Conversely, the reception of the optical energy is interrupted by the opaque portion of wall 1002 in the event of tampering. Particularly, security device 1024 includes an optical emitter 1060 that is aligned with an optical receiver 1062. A body 1076 of device 1024 includes a slot 1084 for receiving a mounting device 1098 that includes a base plate 1000 and an upstanding wall 1002 projecting perpendicularly from base plate 1000. Wall 1002 includes a throughhole 1003 for permitting the passage of optical energy therethrough. Base plate 1000 may be fastened or mounted to a surface 1094 of a structure, such as a door frame, window frame or wall, by screws 1006*a*, 1006*b*. Screws 1006*a*, 1006*b* may extend through respective throughholes in base plate 1000 to thereby secure mounting device 1098 to recessed surface 1094 such that wall 1002 is oriented perpendicular to surface 1094.

Mounting device 1098 may be sized to be snugly received in slot 1084 such that throughhole 1003 is aligned with emitter 1060 and receiver 1062 when security device 1024 is mounted to surface 1094. With emitter 1060, receiver 1062 and throughhole 1003 so aligned, receiver 1062 may receive the optical energy from emitter 1060 when security device 1024 is mounted to surface 1094.

If security device 1024 is removed from surface 1094, throughhole 1003 becomes misaligned with emitter 1060 and receiver 1062. Thus, the opaque portion of upstanding wall 1002 at least temporarily diverts or blocks the optical energy from emitter 1060 from reaching receiver 1062. If receiver 1062 ceases to receive the optical energy from emitter 1060, then it may be assumed that security device 1024 has been removed from surface 1094 or that security device 1024 has been otherwise tampered with. Consequently, security device 1024 may emit a tamper signal, similarly to the embodiment described above with respect to FIG. 2.

While this invention has been described as having an exemplary design, the present invention may be further modified within the spirit and scope of this disclosure. This application is therefore intended to cover any variations, uses, or adaptations of the invention using its general principles.

What is claimed is:

1. A security arrangement comprising:

a mounting device including a diverting element, the mounting device being configured to be mounted to a building structure; and a security device including an optical emitter and an optical receiver, the diverting element being received in the security device when the security device is coupled to the mounting device, the emitter being configured to transmit optical energy that is:

received by the receiver when the security device is decoupled from the mounting device; and diverted by the diverting element such that the optical energy is not received by the optical receiver when the security device is coupled to the mounting device.

2. The arrangement of claim 1 further comprising a controller communicatively coupled to the receiver, the controller being configured to produce a tamper signal in response to the receiver receiving the optical energy.

3. The arrangement of claim 1 wherein the security device is attached to a sensor to be protected from tampering.

4. The arrangement of claim 1 wherein the emitter and the receiver are separated by an air gap, the diverting element being received in the air gap when the security device is coupled to the mounting device.

5. The arrangement of claim 1 wherein the mounting device comprises a base plate and the diverting element comprises an upstanding wall attached to the base plate and oriented at an angle of about ninety degree to the base plate.

6. The arrangement of claim 1 wherein the mounting device is configured to be mounted to one of a door frame and a window frame.

7. The arrangement of claim 1 further comprising a body attached to the security device, the body having a slot with a first width, the emitter and the receiver being disposed on opposite sides of the slot, the diverting element having a second width, the diverting element being received in the slot when the security device is coupled to the mounting device, the first width of the slot being less than twice the second width of the diverting element.

8. The arrangement of claim 1 further comprising a body attached to the security device and configured to cover the mounting device when the security device is coupled to the mounting device.

9. A security arrangement comprising:

a mounting device including an upstanding wall, the mounting device being configured to be mounted to a surface of a structure such that the wall is oriented substantially perpendicular to the surface;

a security sensor configured to sense an event that occurs outside of the security arrangement;

a tamper detector attached to the security sensor, the tamper detector including an optical emitter, an optical receiver, and a slot disposed between the emitter and the receiver, the emitter being configured to transmit optical energy that is received by the receiver through the slot, the wall of the mounting device being received in the slot when the tamper detector is coupled to the mounting device to thereby block the transmission of the optical energy from the emitter to the receiver; and a controller communicatively coupled to the receiver, the controller being configured to produce a tamper signal in response to the receiver receiving the optical energy.

10. The arrangement of claim 9 wherein the mounting device is configured to be mounted to a surface of one of a door frame and a window frame.

11. The arrangement of claim 9 wherein the mounting device comprises a base plate attached to the upstanding wall, the base plate having a substantially planar surface configured to engage the surface of the structure.

12. The arrangement of claim 11 wherein the tamper detector substantially covers the base plate when the tamper detector is coupled to the mounting device.

13. The arrangement of claim 9 wherein the upstanding wall and the slot are sized such that the wall is snugly received in the slot when the tamper detector is coupled to the mounting device.

14. The arrangement of claim 9 wherein the security sensor comprises one of a motion detector and a door/window detector.

15. A security method comprising the steps of:

mounting a mounting device to a surface of a structure such that at least a portion of the mounting device is cantilevered from the surface;

providing a security sensor configured to sense a security breach;

providing a tamper detector including an optical emitter, an optical receiver, and an air gap disposed between the emitter and the receiver, the emitter and receiver being configured such that the receiver is capable of receiving optical energy that is transmitted by the emitter through the air gap;

attaching the tamper detector to the security sensor;

coupling the tamper detector to the mounting device such that the cantilevered portion of the mounting device is received in the air gap to thereby block the transmission of the optical energy from the emitter to the receiver; and producing a tamper signal in the event that the tamper detector is decoupled from the mounting device to thereby enable the receiver to receive the optical energy from the emitter.

16. The method of claim 15 wherein the mounting device is mounted to a surface of one of a door frame and a window frame.

17. The method of claim 15 wherein the coupling step includes substantially covering the base plate with the tamper detector.

18. The method of claim 15 wherein the coupling step includes inserting the tamper detector into a recess in the structure.

19. The method of claim 18 wherein the tamper detector is snugly received in the recess.

20. The method of claim 18 comprising the further step of attaching the tamper detector to the surface to thereby inhibit decoupling of the tamper detector from the mounting device.

21. A security arrangement comprising:

a security device including an optical emitter and an optical receiver; and a mounting device configured to be mounted to a building structure, the mounting device being configured to one of:

allow the receiver to receive optical energy from the emitter when the security device is coupled to the mounting device, and at least temporarily prevent the receiver from receiving optical energy from the emitter when the security device is decoupled from the mounting device; and prevent the receiver from receiving optical energy from the emitter when the security device is coupled to the mounting device, and at least temporarily allow the receiver to receive optical energy from the emitter when the security device is decoupled from the mounting device.

22. The arrangement of claim 21 further comprising a controller communicatively coupled to the receiver, the controller being configured to produce a tamper signal in response to the security device being decoupled from the mounting device as indicated by a change in state of the reception of the optical energy by the receiver.

23. The arrangement of claim 21 wherein the security device is attached to a sensor to be protected from tampering.

24. The arrangement of claim 21 wherein the emitter and the receiver are separated by an air gap, at least a portion of the mounting device being received in the air gap when the security device is coupled to the mounting device.

25. The arrangement of claim 21 wherein the mounting device comprises a base plate and an upstanding wall attached to the base plate, the wall being oriented at an angle of about ninety degree to the base plate.

26. The arrangement of claim 21 wherein the mounting device is configured to be mounted to one of a door frame and a window frame.

27. The arrangement of claim 21 further comprising a body attached to the security device, the body having a slot, the emitter being configured to emit the optical energy into the slot, the receiver being configured to receive the optical energy from the slot, at least a portion of the mounting element being received in the slot when the security device is coupled to the mounting device.

28. The arrangement of claim 21 further comprising a body attached to the security device and configured to cover the mounting device when the security device is coupled to the mounting device.

29. The arrangement of claim 21 wherein the mounting device comprises a base plate and a light pipe disposed within the base plate, the emitter and receiver being unaligned with each other.

30. A security method comprising the steps of:

mounting a mounting device to a surface of a structure;

providing a security sensor configured to sense a security breach;

providing a tamper detector including an optical emitter, an optical receiver, and an air gap disposed between the emitter and the receiver, the emitter and receiver being configured such that the receiver is capable of receiving optical energy that is transmitted by the emitter through the air gap;

attaching the tamper detector to the security sensor;

coupling the tamper detector to the mounting device such that at least a portion of the mounting device is received in the air gap to thereby one of:

block the transmission of the optical energy from the emitter to the receiver; and allow the transmission of the optical energy from the emitter to the receiver; and producing a tamper signal in the event that the tamper detector is decoupled from the mounting device, the decoupling of the tamper detector from the mounting device one of:

allowing the receiver to receive the optical energy from the emitter; and preventing the receiver from receiving the optical energy from the emitter.

31. The method of claim 30 wherein the mounting device is mounted to a surface of one of a door frame and a window frame.

32. The method of claim 30 wherein the coupling step includes substantially covering the base plate with the tamper detector.

33. The method of claim 30 wherein the coupling step includes inserting the tamper detector into a recess in the structure.

34. The method of claim 33 wherein the tamper detector is snugly received in the recess.

35. The method of claim 30 comprising the further step of attaching the tamper detector to the surface to thereby inhibit decoupling of the tamper detector from the mounting device.

* * * * *